US005732544A

United States Patent [19]

Ferguson, Sr.

[11] Patent Number: 5,732,544

[45] Date of Patent: Mar. 31, 1998

[54] TEXTILE YARN TUBE STRIPPER

[76] Inventor: John H. Ferguson, Sr., P.O. Box 116, Linwood, N.C. 27299

[21] Appl. No.: 658,061

[22] Filed: Jun. 4, 1996

[51] Int. Cl.[6] ..... D01H 9/00; B65H 73/00

[52] U.S. Cl. ..... 57/306; 57/305; 28/292

[58] Field of Search ..... 57/300, 303, 304, 57/305, 306; 242/35.5 R, 35.5 A; 28/292, 293, 294, 295, 296, 297; 53/438, 529

[56] References Cited

U.S. PATENT DOCUMENTS

| | | | |
|---|---|---|---|
| 3,587,201 | 6/1971 | Strayer | 53/438 |
| 3,648,554 | 3/1972 | Arnold et al. | 83/169 |
| 3,866,388 | 2/1975 | Koehler, III | 53/59 |
| 3,928,899 | 12/1975 | Maiworm | 28/19 |
| 3,930,293 | 1/1976 | Girard | 28/72 |
| 4,577,453 | 3/1986 | Hofeler | 53/529 |
| 4,742,669 | 5/1988 | Mojden | 53/500 |
| 4,899,532 | 2/1990 | Sanno | 57/305 |
| 4,965,917 | 10/1990 | Ferguson | 28/295 |
| 5,179,769 | 1/1993 | Ferguson | 28/292 |
| 5,195,300 | 3/1993 | Kovacs et al. | 53/529 |
| 5,265,395 | 11/1993 | VanAlstine et al. | 53/444 |

FOREIGN PATENT DOCUMENTS

| | | | |
|---|---|---|---|
| 97972 | 6/1984 | Japan | 28/292 |

*Primary Examiner*—Daniel P. Stodola
*Assistant Examiner*—Tina R. Taylor
*Attorney, Agent, or Firm*—Rhodes Coats & Bennett, L.L.P.

[57] ABSTRACT

A yarn remnant removal system for flexible textile yarn tubes deflects the textile yarn tube inwardly in order to effectively reduce the tube circumference and loosen the yarn remnants wrapped thereon. The system provides for a tube receiver over which a textile yarn tube is placed and a deflection arm or blade which operates to engage and deflect the textile yarn tube inwardly while the tube rests on the tube receiver. Preferably, the tube receiver will include vacuum cups for providing a vacuum to engage a deflected portion of the textile yarn tube and to hold the textile yarn tube in an inwardly deflected state. The textile yarn tube remains deflected after the deflection arm is released. Multiple jets of air may be used to blow the yarn remnants from the textile yarn tube and the tube receiver may be rotated downwardly into a vertical position to further facilitate remnant removal.

35 Claims, 8 Drawing Sheets

TEXTILE YARN TUBE STRIPPER

BACKGROUND OF THE INVENTION

The present invention relates generally to stripping textile yarn remnants from a textile yarn tube and, more particularly, to a system for stripping textile yarn remnants from a flexible textile yarn tube in an efficient and non-destructive manner, and to providing an associated system and method for efficiently packing and binding bundles of such tubes.

During various stages of textile processing, textile yarn is wrapped, stored, shipped, and processed on one or more cylindrical or conical tubes. These tubes are often referred to as bobbins or spools. The term "tubes," as used herein, encompasses the various types of yarn holding devices of similar kind. The present invention focuses on flexible tubes, i.e., tubes that are capable of being non-destructively flexed inwardly to permit yarn to be sloughed off.

Textile yarn tubes represent a cost in textile processing and manufacturing, so having the ability to reuse the tubes is important. Unfortunately, due to the nature of textile manufacturing, residual yarns are often left on the tubes. Thus, the textile yarn remnants must be removed prior to reusing the tubes.

For the most part, textile yarn tubes are substantially rigid and inflexible. Prior art yarn strippers are directed towards systems and methods which remove remnants without harming or compromising the integrity of the tube. Given the inflexible nature of the tubes, these prior art systems focused on removing the yarn without, or only minimally contacting the tube surface. A primary objective of these stripping systems is to avoid significant contact with the textile yarn tube. Deformation, deflection, or other potentially harmful manipulation were carefully avoided.

Typically, the prior art techniques use various combinations of cutting, scraping, clawing, and blowing to facilitate remnant removal from the tubes. Each aspect is directed towards minimizing contact between the removal apparatus and the textile yarn tube. Minimizing damage and other wear and tear to the textile yarn tube significantly increases the life of the rigid tubes of the prior art and significantly reduces operational costs. Currently, large diameter, flexible textile yarn tubes are available and used for fiberglass yarn. The emphasis on designing yarn strippers for rigid textile yarn tubes has left a void in the yarn remnant stripping art relating to flexible textile yarn tubes since the rigid tube strippers are not compatible with flexible tubes.

Prior to the current invention, yarn remnants on flexible textile yarn tubes were removed by collapsing the textile yarn tubes manually and sliding the yarn remnants from the tube surface manually. Partially collapsing the tube reduces the effective circumference of the textile yarn tube and loosens the remnants for removal. Workers employed to strip yarn from these tubes would strip thousands of tubes each day. Given the tremendous number of tubes to strip and repetitive motions involved in stripping the tubes, workers sometimes developed repetitive motion injuries. Furthermore, since the flexible tubes are typically relatively large in diameter and length, manual stripping is awkward and time consuming.

Thus, there is a need for a system capable of efficiently stripping textile yarn remnants from the flexible textile yarn tubes. The focus on non-destructive and little or low contact stripping systems fails to provide a system operable on flexible textile yarn tubes. A need remains for a system capable of partially collapsing or inwardly deflecting a textile yarn tube in order to loosen the yarn remnants, and holding the textile yarn tube in an inwardly deflected state to allow easy removal of the yarn remnants. A further need exists for a system capable of collapsing multiple textile yarn tubes into a bundle to facilitate binding, transport, and storage of the bundle.

SUMMARY OF THE INVENTION

The present invention is directed to a yarn remnant removal system for flexible textile yarn tubes. The system deflects the textile yarn tube inwardly in order to effectively reduce the tube circumference and loosen the yarn remnants wrapped thereon. The system provides for a tube receiver over which a textile yarn tube is placed and a deflection arm or blade which operates to engage and deflect the textile yarn tube inwardly while the tube rests on the tube receiver. Preferably, the tube receiver will include vacuum cups for providing a vacuum to engage a deflected portion of the textile yarn tube and to hold the textile yarn tube in an inwardly deflected state. The textile yarn tube remains deflected after the deflection arm is released. Multiple jets of air may be used to blow the yarn remnants from the textile yarn tube, and the tube receiver may be rotated downwardly into a vertical position to further facilitate remnant removal.

Accordingly, one aspect of the current invention is to provide a yarn stripper having a tube receiver adapted to receive a textile yarn tube having yarn remnants wrapped about the textile yarn tube. The tube receiver includes a first tube support surface spaced apart from and parallel to a second tube support surface. The tube support surfaces are adapted to receive the textile yarn tube through an inside opening of the textile yarn tube and support an inside surface of the textile yarn tube. The yarn stripper further includes a deflection arm operatively associated with the tube receiver and adapted to move downwardly between the tube support surfaces. The deflection arm is operable to engage an outside surface of and inwardly deflect the textile yarn tube when the textile yarn tube is positioned on the tube receiver. When a textile yarn tube is inserted on the tube receiver and inwardly deflected by the deflection arm, the yarn remnants on the textile yarn tube become loose for easy removal.

Another aspect of the current invention is to provide a yarn stripper wherein the tube receiver further comprises a deflected tube holder between below the tube support surfaces. The deflected tube holder uses a vacuum to securely engage a deflected portion of the inside surface of the textile yarn tube when the deflection arm inwardly deflects the textile yarn tube. The vacuum is used to hold the textile yarn tube in a deflected position. The deflection arm is usually adapted to travel past the support surfaces for inwardly deflecting the textile yarn tube and to move upwardly away from the textile yarn tube after deflecting the textile yarn tube inward.

The yarn stripper may have one or more air jets operatively associated with the tube receiver and adapted to provide a stream of air across the outside surface of the textile yarn tube to facilitate yarn remnant removal once the textile yarn tube is inwardly deflected. The air jets are preferably spaced circumferentially about the tube receiver.

The tube receiver is preferably pivotally mounted and adapted to pivot to a substantially vertical orientation when the textile yarn tube is inwardly deflected to facilitate removal of the yarn remnants from the textile yarn tube.

Yet another aspect of the current invention is to provide a method of yarn remnant removal from a textile yarn tube including the following steps: (a) placing a textile yarn tube having yarn remnants on two tube support surfaces; (b) inwardly deflecting the textile yarn tube with a deflection arm to loosen the yarn remnants on the textile yarn tube; (c) holding the textile yarn tube in an inwardly deflected state; and (d) removing the yarn remnants from the textile yarn tube. The method may further include the step of jetting air across the textile yarn tube to facilitate removal of the yarn remnants from the textile yarn tube, after pivoting the textile yarn tube while in the inwardly deflected state to a vertical orientation to facilitate yarn removal or a combination thereof.

Still another aspect of the current invention is to provide for an apparatus for collapsing flexible .textile yarn tubes into layered bundles capable of being bound. The apparatus includes: (a) two spaced apart vertically extending side walls; (b) two parallel textile yarn tube support surfaces between the side walls and spaced apart sufficiently to rest a textile yarn tube thereon in a horizontal position; and (c) a deflection arm operatively associated with the tube support surfaces and configured to move downwardly between the tube support surfaces, when a textile yarn tube is placed on the tube support surfaces to inwardly deflect and collapse the textile yarn tube into a U-shaped orientation. Multiple textile yarn tubes may be vertically stacked on each other between the tube support surfaces and the deflection arm and collapsed into a layered bundle of textile yarn tubes when the deflection arm moves downwardly through the tube support surfaces. The apparatus is preferably associated with the yarn stripper to provide efficient yarn stripping and subsequent tube bundling.

Yet a further aspect of the current invention is to provide a method of collapsing flexible textile yarn tubes including the steps of: (a) providing two spaced apart vertically extending side walls; (b) providing two parallel textile yarn tube support surfaces between the two walls and spaced apart sufficiently to rest a textile yarn tube thereon in a horizontal position; (c) providing a deflection arm operatively associated with the tube support surfaces and configured to move downwardly between the tube support surfaces when a textile yarn tube is placed on the tube support surfaces to inwardly deflect and collapse the textile yarn tube into a U-shaped orientation; (d) inwardly deflecting and collapsing a plurality of textile yarn tubes into a layered U-shaped bundle by moving the deflection arm downwardly between the tube support surfaces; and (e) binding the bundle of textile yarn tubes. The method may further include the step of providing an additional textile yarn tube and wherein the binding step includes sliding the additional textile yarn tube over the bundle of textile yarn tubes. The additional textile yarn tube is used to bind the bundle.

These and other aspects of the present invention will become apparent to those skilled in the art after a reading of the following description of the preferred embodiments when considered with the drawings.

DETAILED DESCRIPTION OF THE PREFERRED EMBODIMENTS

Figure 1:
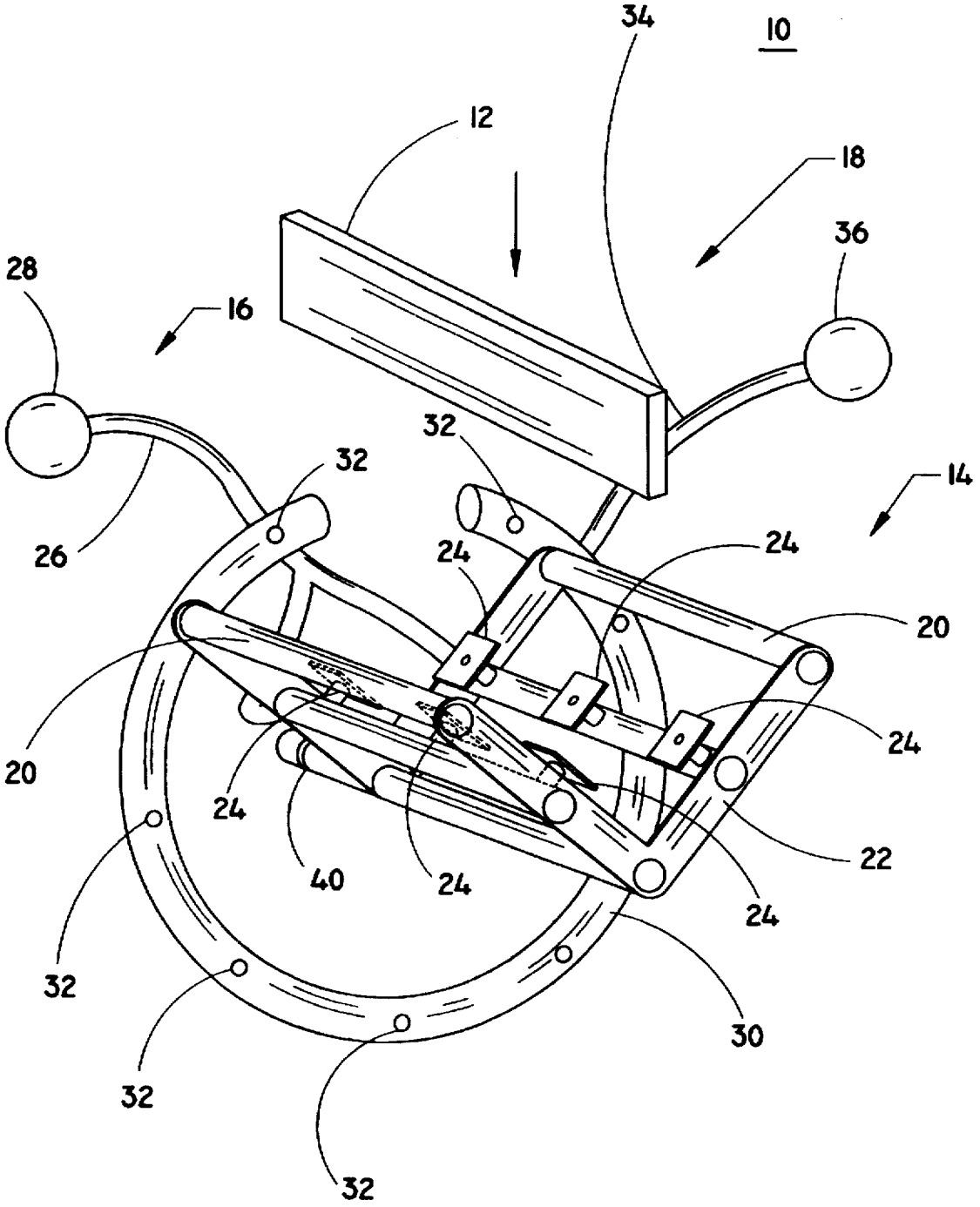
FIG. 1 is a schematic view of the operative elements of a yarn stripper constructed according to a preferred embodiment of the present invention.

In the following description, like reference characters designate like or corresponding parts throughout the several views. Also in the following description, it is to be understood that descriptive terms such as upwardly, inwardly, downwardly and the like, are words of convenience and are to be construed as limiting terms. Referring now to the drawings in the general, and FIG. 1 in particular, it will be understood that the illustrations are for the purpose of describing a preferred embodiment of the invention and are not intended to limit the invention thereto.

As best seen in FIG. 1, a yarn stripper generally designated 10, is shown constructed according to the present invention. The yarn stripper 10 preferably includes four major sub-assemblies: a deflection arm 12; a tube receiver assembly 14; a vacuum 16; and a high velocity air system 18.

The tube receiver assembly 14 is shown in a V-shaped cradle configuration having parallel tube support surfaces 20 supported by a frame 22. The frame 22 preferably includes multiple vacuum cups 24 facing inwardly and spaced along and parallel to both tube support surfaces 20. The vacuum cups 24 operatively communicate with a vacuum pump 28 through a vacuum hose 26 to form the vacuum system 16.

The tube receiver assembly 14 is circumferentially surrounded by an air manifold 30 having multiple air holes 32 spaced equally thereon. The air holes 32 are oriented in a manner to provide high velocity air streams axially along the length of the tube receiver assembly 14. Air is provided to the air manifold 30 via an air hose 34 and an air pump 36.

The deflection arm 12 is operatively configured to move from a position away from the tube support surfaces to a position towards the tube receiver 14 and between the tube support surfaces 20. Preferably, the deflection arm 12 moves to a position substantially near the inwardly opposing vacuum cups 24. Additionally, the tube receiver 20 is configured to pivot between horizontal and vertical orientations via a hinged control arm 40.

Figure 2A:
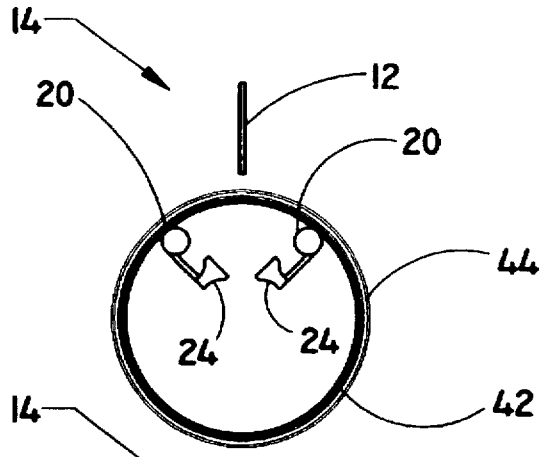
FIGS. 2*a*–2*d* are schematic representations of the operation of a yarn stripper constructed according to the embodiment of FIG. 1.

In use, as best seen in FIGS. 2*a*–2*d*, a flexible, cylindrical textile yarn tube 42 having textile yarn remnants 44 is manually placed over the tube receiver assembly 14. The textile yarn tube 42 rests on the tube support surfaces 20. As shown in FIG. 2*a*, an upper portion of the textile yarn tube 42 is between the deflection arm 12 and the tube support surfaces 20. The textile yarn tube 42 will remain in a more or less cylindrical configuration in this position.

Figure 2B:
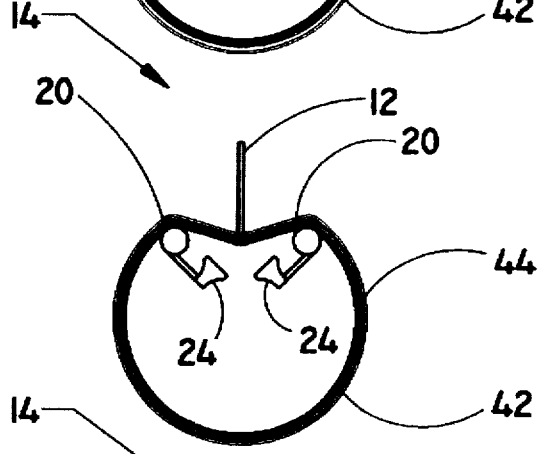
Figure 2C:
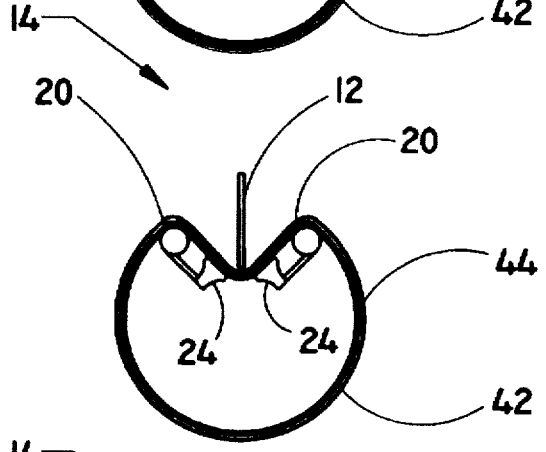

In operation, the deflection arm 12 is lowered towards the tube receiver assembly 14 and between the tube support surfaces 20. As shown in FIG. 2*b*, the deflection arm 12 contacts the textile yarn tube 42 and yarn remnants 44, and proceeds to inwardly deflect the textile yarn tube 44. FIG. 2*c* depicts the continued progression of the deflection arm 12.

Figure 2D:
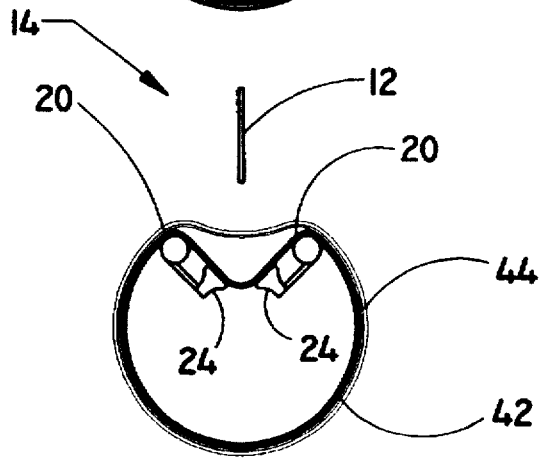

The deflection arm 12 will continue until the deflected portions of the textile yarn tube 44 engages, or is pulled to, the vacuum cups 24 by the vacuum created by the vacuum system 16. The vacuum created at the vacuum cups 24 is sufficient to hold the textile yarn tube 42 in an inwardly deflected state. Once the inwardly deflected portion of the textile yarn tube 42 is secured by the vacuum cups 24, the deflection arm 12 is raised above the textile yarn tube 44 sufficiently to lose contact with the textile yarn tube 42 and yarn remnants 44 as shown in FIG. 2*d*. When the textile yarn tube 42 is in an inwardly deflected state, the effective circumference for the yarn remnants 44 is significantly reduced. In this state, the yarn remnants 44 loosely hang about the textile yarn tube 42.

Figure 3:
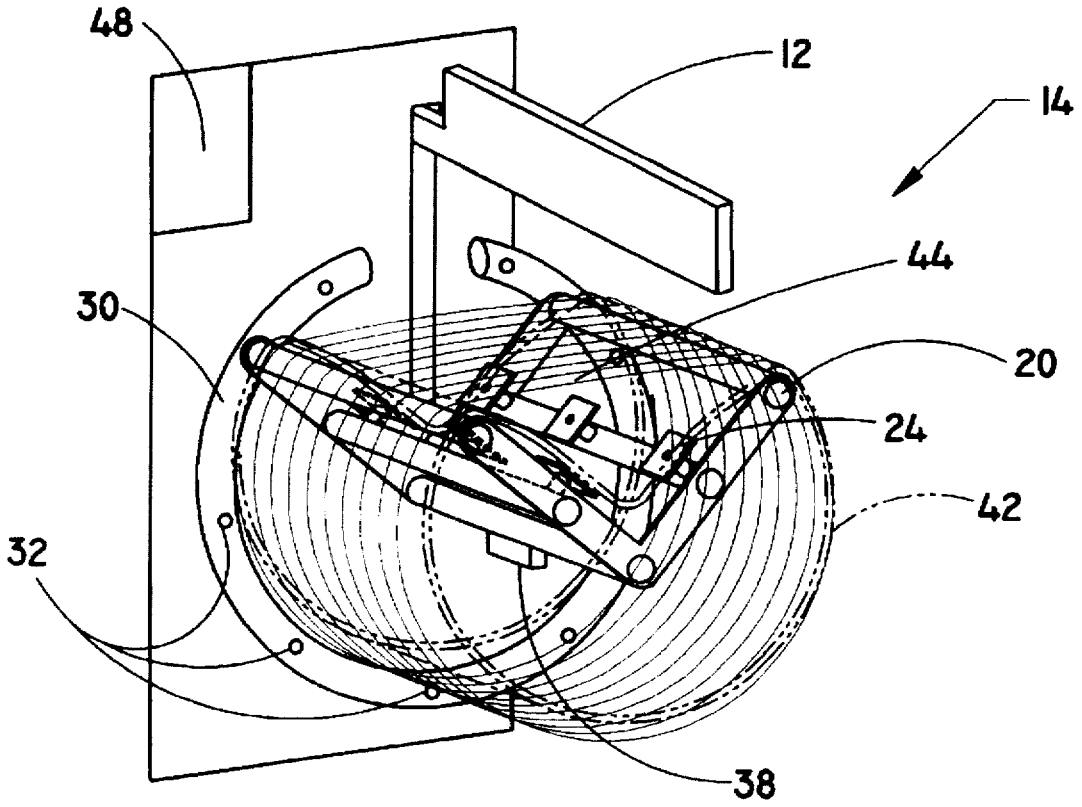
FIG. 3 is a perspective view of a yarn stripper constructed according to the embodiment of FIG. 1 after deflecting a textile yarn tube.

Turning now to FIG. 3, the loose fitting yarn remnants 44 may be removed by hand or by air flow along the textile yarn tube 42 from the various air holes 32 in the air manifold 30. Once the yarn remnants 44 are removed, the vacuum provided at vacuum cups 24 is released to provide easy removal of the remnant-free textile yarn tube 42 from the tube receiver assembly 14.

A tube position sensor 38 may be associated with the tube receiver assembly 14 to alert the controller when a textile yarn tube 42 has been placed on or removed from the tube receiver assembly 14. Additionally, the sensor 38 may be configured to indicate when a textile yarn tube is damaged or deformed. Preferably, the sensor 38 is a photoeye positioned to trigger and send an appropriate signal to the control module 48 to alert the system when a textile yarn tube is placed on or removed from the tube receiver assembly 14.

Figure 4A:
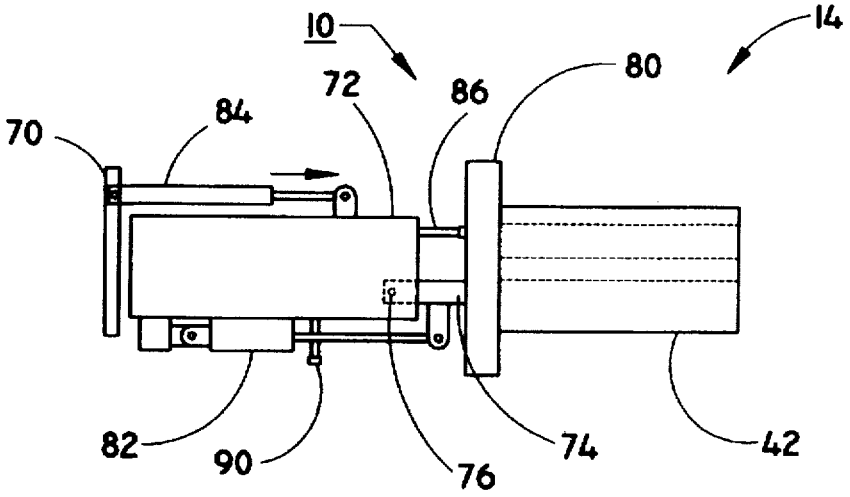
FIGS. 4*a*, 4*b* and 4*c* are side view representations of the operation of a yarn stripper constructed according to the embodiment of FIG. 1.
Figure 4B:
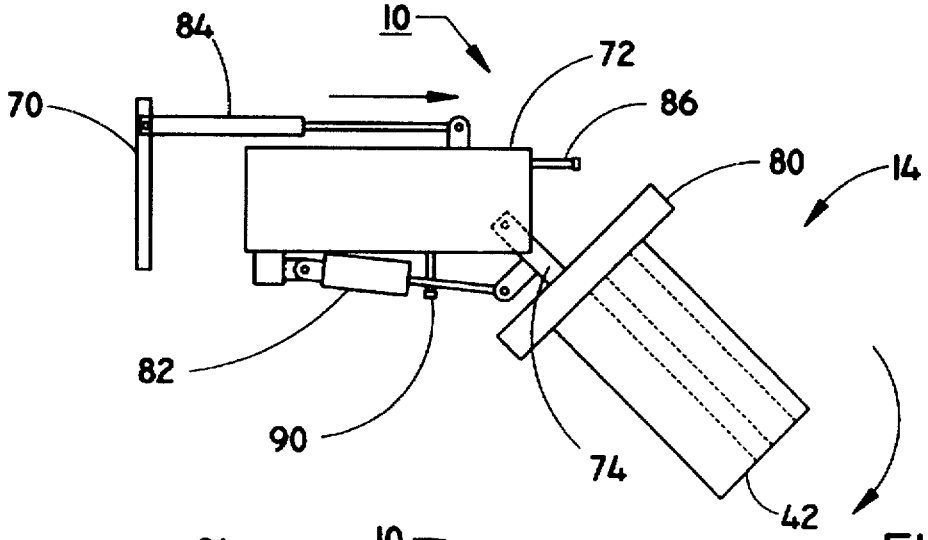
Figure 4C:
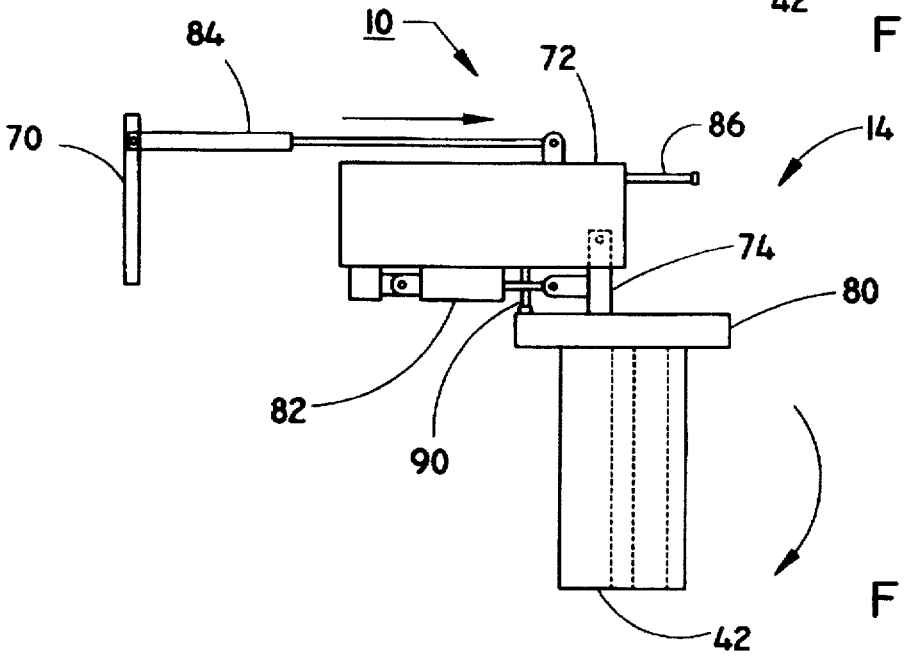

Referring now to FIGS. 4*a*, 4*b* and 4*c*, the tube stripper 10 is configured to rotate the inwardly deflected textile yarn tube 42 from a horizontal to a vertical orientation. The tube stripper 10 is configured to move horizontally outward as the tube 42 is rotated downward so that the outer end of the tube 42 in the horizontal orientation is in roughly the same position as the outer side of the tube 42 in the vertical orientation. In order to achieve the preferred positioning, the textile yarn tube 42 must slide outward as it is rotated downward.

In the preferred embodiment, the yarn stripper 10 further includes a stationary frame 70, a slidable support frame 72, a tube receiver support 74 and a hinge 76 to allow the tube receiver 14 to pivot from the horizontal orientation to the vertical orientation. A tube stop 80 provides a backstop when placing textile yarn tubes 42 on the tube receiver 14. A pneumatic or hydraulic hinge actuator 82 is mounted between the slidable support frame 72 and the tube receiver mount 74 to pivotally move the tube receiver 14 between the vertical and horizontal orientations. A linear actuator 84 is used to horizontally move the support frame 72 away from the stationary frame 70. Both the hinged actuator 82 and the linear actuator 84 are controlled by the control module 48. Thus, when the photoeye sensor 38 senses that a tube 42 is appropriately placed on the tube receiver 14, the control module 48 will simultaneously have the tube receiver 14 slide outward and pivot downward to an outwardly extended vertical position. The process is reversed once the yarn renmants 44 are removed.

Limit switches 86, 90 may be used to inform the control module 48 when the tube receiver 14 is in a fully vertical or horizontal orientation. The horizontal limit switch 86 is closed by the tube stop 80 when the tube receiver 14 is in a fully horizontal position. The vertical limit switch 90 is closed by the tube stop 80 when the tube receiver 14 is in a fully vertical orientation. Limit switches may also be used to signal the control module 38 when the slidable support frame 72 is at the beginning or fully extended position.

Figure 5:
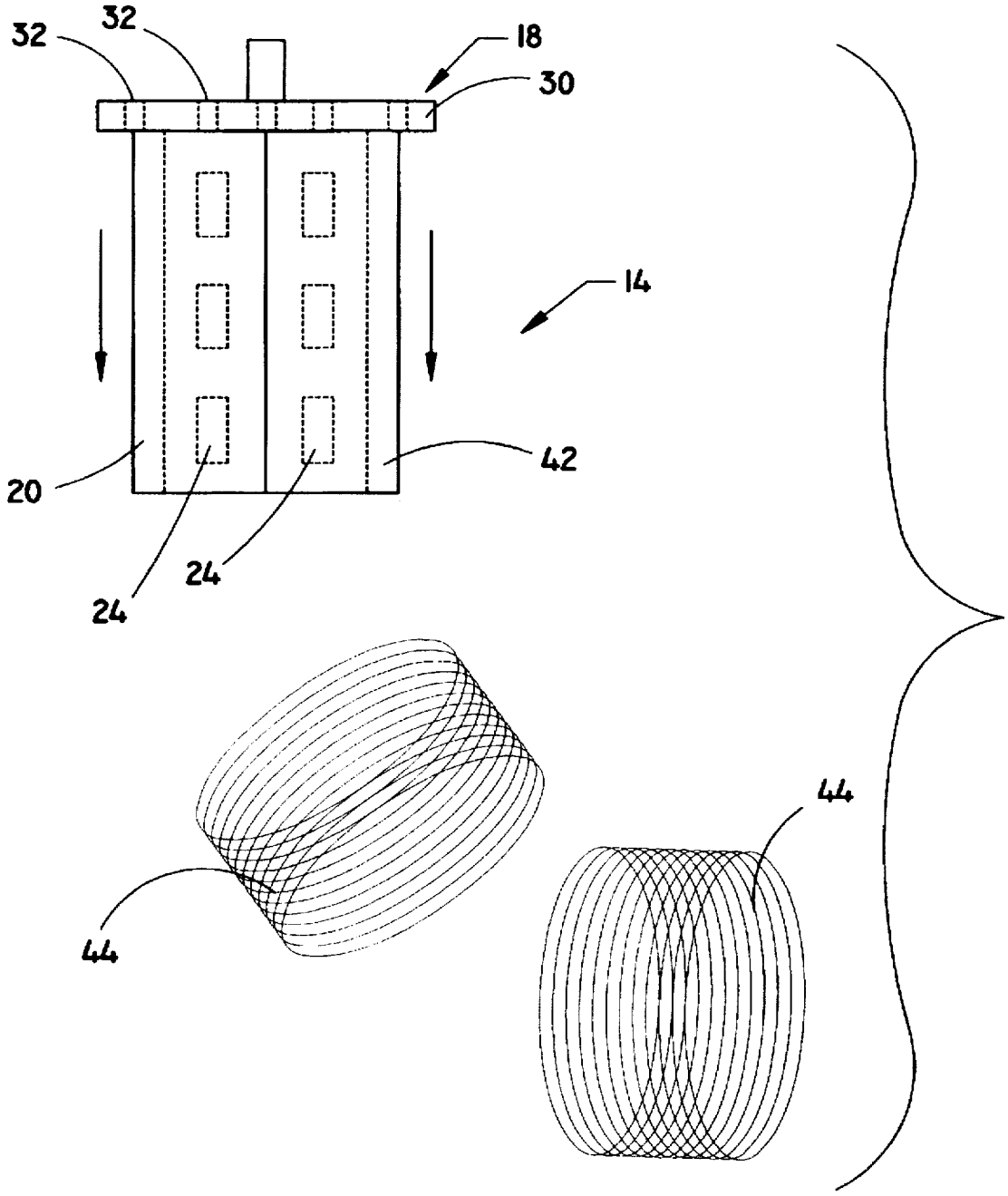
FIG. 5 is a perspective view of the embodiment of FIG. 1.

As best shown in FIG. 5, yarn remnant removal is further enhanced if the tube receiver assembly 14 and the high velocity air system 18 are configured to rotate together from a horizontal to a vertical orientation after a textile yarn tube 42 having yarn remnants 44 is loaded and inwardly deflected. The combination of high velocity air from the air holes 32 in the air manifold 30 in combination with gravitational forces provide exceptionally easy yarn remnant removal. The vacuum cups 24 may then release the textile yarn tube 42 in the vertical, horizontal, or any position therebetween.

Figure 6:
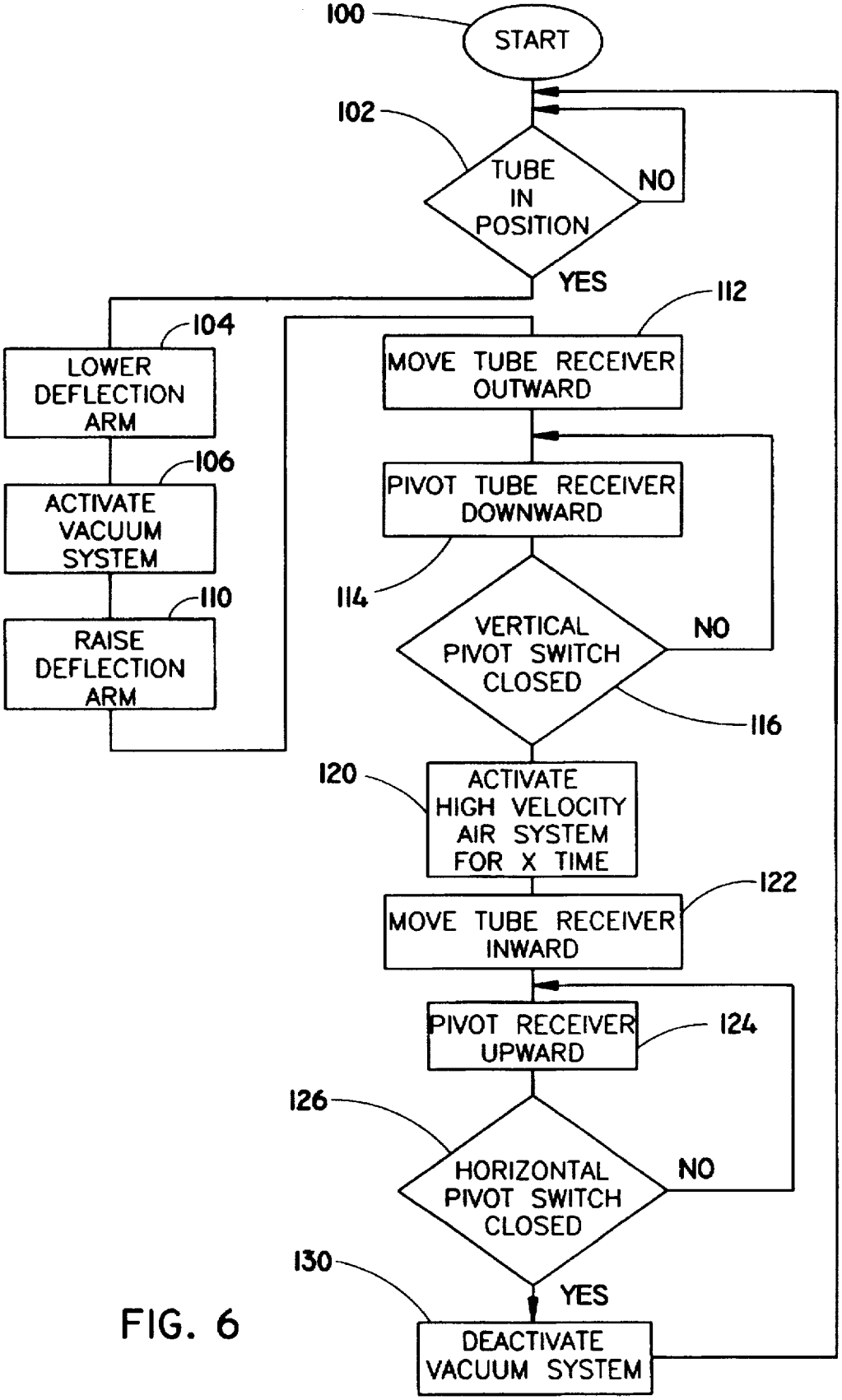
FIG. 6 is a flow chart of the control process of the embodiment of FIG. 1.

A control module 48 may be provided to further automate operation of the deflection arm 12, tube receiver assembly 14, associated vacuum system 16, and high velocity air system 18. Attention is now directed to the flow chart of FIG. 6. The process starts at Block 100 and first determines whether or not a textile yarn tube 42 is in position at decision Block 102. If a tube is not in position, the control module will continue to check the sensor 38 until a tube is placed on the tube receiver 14. Once a tube is in position on the tube receiver 14, the deflection arm 12 is lowered at Block 104 and the vacuum system is activated at Block 106. The deflection arm will lower until the vacuum system engages and inwardly deflects the textile yarn tube 42. Once the textile yarn tube 42 is engaged, the deflection arm 12 is raised at Block 110.

As discussed with reference to FIG. 4, the tube receiver 14 is moved outward at Block 112 and pivoted downwardly at Block 114. The tube receiver 14 will move outwardly to a preselected position. The control module 38 will monitor the status of the vertical pivot switch 90. Once the switch is closed, the tube receiver 14 is in a vertical position and the control module 38 will stop pivoting the tube receiver 14 downward at decision Block 116. Once in the vertical orientation, the high velocity air system 38 is activated at Block 120 for a select amount of time or until the yarn remnants 44 are removed.

At this point, the tube receiver 14 is moved inwardly and pivoted upwardly at Blocks 122 and 124, respectively. The tube receiver 14 is pivoted until the horizontal pivot switch 86 is determined to be closed at decision Block 126. Once the tube receiver 14 is in its original position, the vacuum system is deactivated at Block 130 to allow the textile yarn tube 42 to be removed and another tube to be placed onto the tube receiver 14 so that the process may be repeated.

Figure 7:
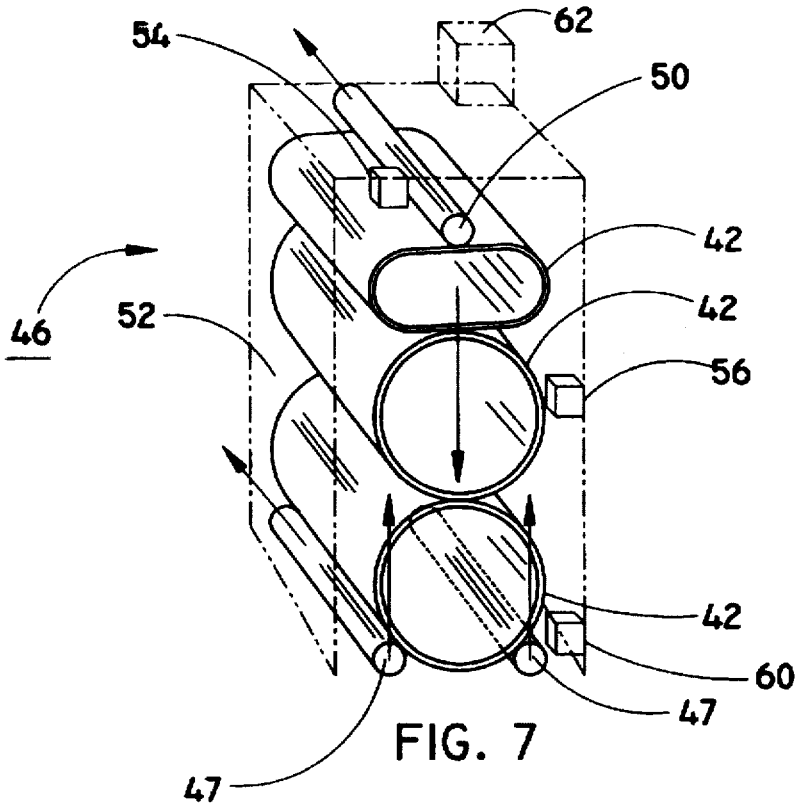
FIG. 7 is a perspective view of a textile yarn tube binding apparatus constructed according to a preferred embodiment of the present invention.

Another aspect of the current invention is shown in FIG. 7. Given the tremendous volume of textile yarn tubes 42 handled, a quick and effective way of storing and packaging these textile yarn tubes 42 is desired. A packaging system 46 is depicted having two substantially parallel support surfaces 47 and a deflection arm 50. The support surfaces 47 are spaced apart a distance less than the tubes' diameter so that the textile yarn tubes will lay horizontally upon the support surfaces 47.

Figure 8A:
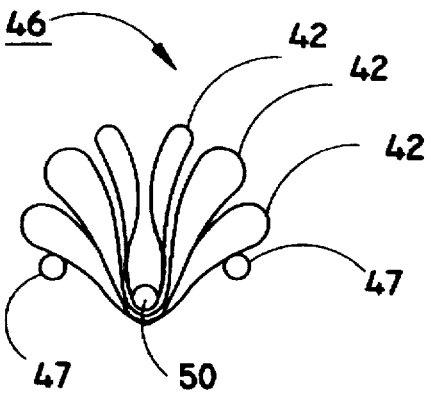
FIGS. 8*a*, 8*b* and 8*c* are schematic representations of the operation of a textile yarn tube binding apparatus of FIG. 7.

The deflection arm 50 is configured to move between and past the support surfaces 47 to inwardly deflect and fully collapse the textile yarn tube 42 into a U-shaped configuration. In the preferred embodiment, the support surfaces 47 are configured to move upwardly to help further collapse the textile yarn tubes 42. The process may be repeated successively to form a bundle of collapsed textile yarn tubes as shown in FIG. 8*a*. The bundle may then be bound and removed from the support surfaces 47.

Figure 8B:
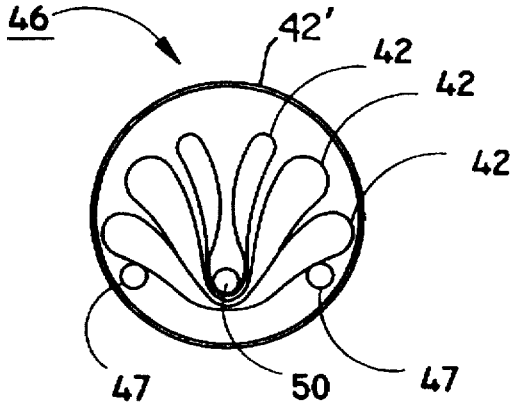
Figure 8C:
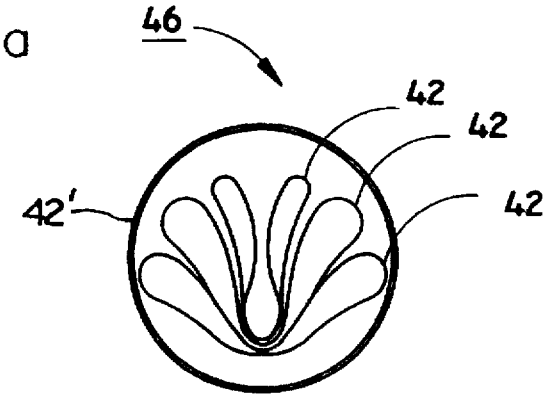

Preferably the support surfaces 47 and deflection arm 50 are within a cabinet 52 having a width greater than the distance between the tube support surfaces 47 and slightly greater than a diameter of the textile yarn tubes 42. The height of cabinet 52 is preferably great enough to vertically stack multiple textile yarn tubes 42 on the support surfaces 47. As seen in FIGS. 7 and 8*a*, multiple textile yarn tubes 42 may be deflected simultaneously as the deflection arm 50 proceeds to collapse each textile yarn tube 42 into a layered bundle. The cabinet 52 ensures proper alignment of the stacked textile yarn tubes 42 during operation. Successive operations quickly produce large bundles of collapsed textile yarn tubes 42. The bundles may be bound by conventional means. Preferably, another textile yarn tube 42 is used to bind the bundle of collapsed textile yarn tubes 42 by simply slipping the textile yarn tube 42' over the bundle and tube support surfaces 47 (FIG. 8*b*). Then the parts 47 and 50 withdraw axially to make a bundled package (FIG. 8*c*). The bound bundle is easily removed for storage or shipment.

Figure 9:
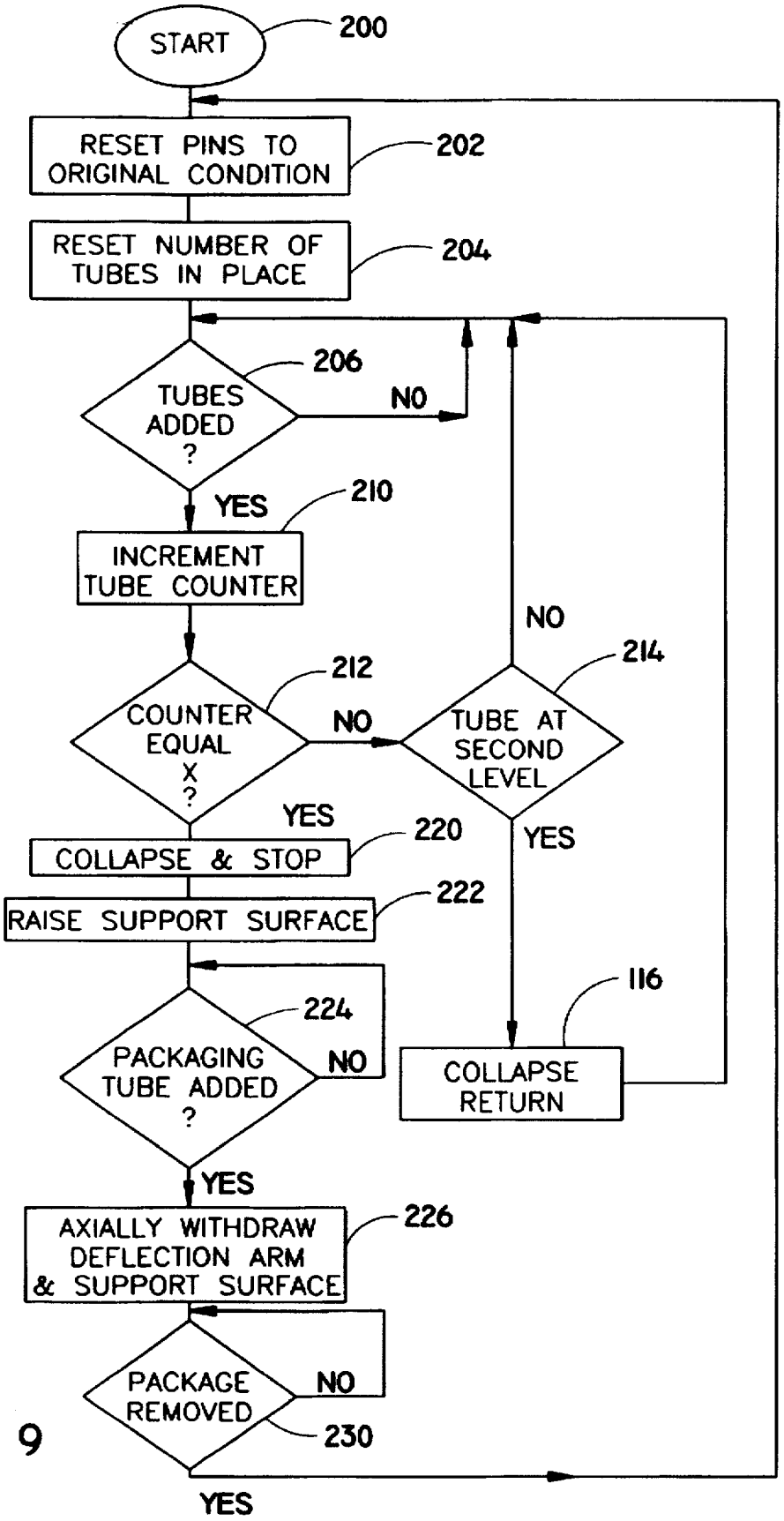
FIG. 9 is a flow chart of the control process of the embodiment of FIG. 7.

The packaging system 46 is preferably automated and controlled by a control module 62, which is configured to control the operation of the deflection arm 50 and the support surfaces 47. Additionally, multiple sensors 54, 56 and 60 are positioned to determine the number of tubes being collapsed and the position of certain of these tubes during operation. Preferably, the sensors 54, 56 and 60 are photoeyes or photosensors. A first sensor 54 is used to count the number of tubes placed in the packaging system 46. The second sensor 56 is placed on the cabinet 52 at a level in which the tubes should be collapsed. A third sensor 60 is positioned at or near the bottom of the cabinet 52 in order to sense the placement of the textile yarn tube 42 used to slip over and bind the bundle of textile yarn tubes. The preferred process is outlined in the flow chart of FIG. 9.

The process starts at Block 200 and resets or checks to see that the reset pins are in the original position at Block 202. The control module 62 is adapted to keep track of the number of tubes placed in the cabinet 52. A tube counter is reset to zero at Block 204. At this point, the packaging system 46 waits until a tube is placed into the cabinet 52 at decision Block 206. Each time a tube is placed into the cabinet 52, sensor 54 sends a signal to the control module 62 accordingly. A tube counter is incremented at Block 210. Next, the control module 62 determines whether or not a select number of tubes to be packaged within one bundle has been reached at decision Block 212. Preferably, three tubes are packaged in a fourth tube or seven tubes are packaged in an eighth tube.

Until the select number of tubes to be packaged is reached, the control module 62 determines whether or not there are uncollapsed tubes stacked upon one another sufficient to reach the level of sensor 56. If the tubes do not reach the level of the sensor 56, then the control module 62 waits for another tube to be added at decision Block 206. If the tubes reach the level of the second sensor 56, the deflection arm 50 is activated and collapses the tubes present within the cabinet 52, and returns to its normal position at the top of the cabinet 52. The control module 62 then waits for additional tubes to be added at decision Block 206.

Once the control module 62 determines that the select number of tubes have been added at decision Block 212, the deflection arm 50 is activated to collapse the tubes present within the cabinet. During the various collapsing actions by the deflection arm 50, multiple uncollapsed tubes are collapsed into an existing bundle of tubes collapsed during a previous employment of the deflection arm 50. Once the deflection arm 50 has collapsed the select number of tubes to be bound, the deflection arm 50 stops at the lowered collapsing position and, preferably, the support surfaces 47 are raised upward to further tightly collapse the tubes. At this point, an operator will slide another tube over the bundle for binding. The control module 62 will monitor, via sensor 60, for placement of the binding tube at decision Block 224. Once the packaging tube 42' is placed over the bundle, the deflection arm 50 and the support surfaces 47 are axially withdrawn at Block 226 to provide unobstructed removal of the bound bundle of tubes. The control module 62 will recognize when the package is removed at decision Block 230 with sensor 60. Once the bound bundle is removed, the process will repeat itself accordingly.

Certain modifications and improvements will occur to those skilled in the art upon a reading of the foregoing description. Multiple variations of the tube receiving assembly and deflection arm operation and configuration are possible. It should be understood that all such modifications and improvements have been deleted herein for the sake of conciseness and readability, but are properly within the scope of the following claims.

I claim:

1. A textile yarn tube stripper for removing yarn from a flexible tube having an opening and an inside surface comprising:

a tube receiver adapted to receive a textile yarn tube having yarn wrapped about the textile yarn tube, said tube receiver having a first tube support surface spaced apart from and parallel to a second tube support surface, said tube support surfaces adapted to receive the textile yarn tube through the opening of the textile yarn tube and support the inside surface of said textile yarn tube; and a deflection arm operatively associated with said tube receiver and adapted to move from a position away from said tube support surfaces to a position between said tube support surfaces, said deflection arm being operable to engage an outside surface of and inwardly deflect the textile yarn tube when the textile yarn tube is positioned on said tube receiver;

wherein when a textile yarn tube having yarn thereon is inserted on said tube receiver and inwardly deflected by said deflection arm, the yarn on the textile yarn tube becomes loosened from the tube by an effective reduction in the diameter of the tube for easy removal.

2. The apparatus of claim 1 wherein said tube receiver further comprises a tube holder between and below said tube support surfaces, said tube holder adapted to engage a deflected portion of the inside surface of the textile yarn tube when said deflection arm inwardly deflects the textile yarn tube.

3. The apparatus of claim 2 wherein said tube holder includes a vacuum system adapted to create a vacuum to securely engage the deflected portion of the inside surface of the textile yarn tube when said deflection arm inwardly deflects the textile yarn tube, said vacuum used to hold the textile yarn tube in a deflected position during remnant removal.

4. The apparatus of claim 3 wherein said vacuum system has a plurality of vacuum cups oriented to fade and engage the deflected portion of the textile yarn tube when the textile yarn tube is inwardly deflected.

5. The apparatus of claim 4 wherein said vacuum cups are aligned parallel to said tube support surfaces.

6. The apparatus of claim 4 wherein said vacuum cups are aligned along two rows, said rows are parallel to said tube support surfaces and said vacuum cups on said rows are angled inwardly and upwardly to engage opposing sides of the deflected portion of the textile yarn tube when the textile yarn tube is inwardly deflected.

7. The apparatus of claim 1 wherein said deflection arm is further adapted to move away from the textile yarn tube after inwardly deflecting the textile yarn tube.

8. The apparatus of claim 1 further comprising one or more air jets operatively associated with said tube receiver and adapted to provide a stream of air across the outside surface of the textile yarn tube to facilitate yarn removal once the textile yarn tube is inwardly deflected.

9. The apparatus of claim 8 wherein said air jets are spaced circumferentially about said tube receiver.

10. The apparatus of claim 1 wherein said tube receiver is pivotally mounted and adapted to pivot to a substantially vertical orientation when the textile yarn tube is inwardly deflected to facilitate removal of the yarn from the textile yarn tube.

11. The apparatus of claim 1 wherein said deflection arm is adapted to travel past said support surfaces to inwardly deflect the textile yarn tube.

12. The apparatus of claim 1 further comprising tube sensor operatively associated with said tube receiver and adapted to sense placement of the textile yarn tube on said tube receiver.

13. The apparatus of claim 12 wherein said tube sensor is further adapted to sense removal of the textile yarn tube from said tube receiver.

14. The apparatus of claim 12 wherein said tube sensor is a photosensor.

15. The apparatus of claim 1 further comprising a controller adapted to control operation of said deflection arm and said tube receiver.

16. A textile yarn tube stripper as claimed in claim 1 further comprising a flexible textile yarn tube binding apparatus having:

two spaced apart vertically extending side walls;

two parallel textile yarn tube support surfaces between said side walls and spaced apart a distance that permits a textile yarn tube to rest thereon in a horizontal position; and a deflection arm operatively associated with said tube support surfaces and configured to move from a position away from said tube support surfaces to a position between said tube support surfaces when the textile yarn tube is placed on said tube support surfaces to inwardly deflect and collapse said textile yarn tube into a U-shaped orientation;

wherein a plurality of the textile yarn tubes may be vertically stacked on each other between said tube support surfaces and said deflection arm and collapsed into a layered bundle of the textile yarn tubes in a U-shape when said deflection arm moves between said tube support surfaces.

17. The apparatus of claim 16 wherein said tube support surfaces are configured to move from an original position toward said position away from said tube support surfaces to further collapse said layered bundle of textile yarn tubes.

18. The apparatus of claim 16 further comprising a controller adapted to control said deflection arm.

19. The apparatus of claim 18 further comprising a placement sensor associated with said controller adapted to provide signals to said controller when a textile yarn tube is placed within said binding apparatus, said controller adapted to count said textile yarn tubes.

20. The apparatus of claim 18 further comprising a level sensor associated with said controller adapted to determine a level of textile yarn tubes present within said binding apparatus, said controller adapted to deflect said tubes when said level is determined.

21. The apparatus of claim 18 further comprising a binding sensor associated with said controller adapted to determine when said collapsed bundle of textile yarn tubes is bound by sensing a textile tube placed around said collapsed bundle.

22. The apparatus according to claim 16 wherein said tube support surfaces and said deflection arm are adapted to axially retract out of said collapsed bundle of textile yarn tubes to facilitate removal thereof.

23. A textile yarn tube stripper as claimed in claim 1 further comprising a flexible textile yarn tube binding apparatus having:

two spaced apart vertically extending side walls;

two parallel textile yarn tube support surfaces between said side walls and spaced apart a distance that permits a textile yarn tube to rest thereon in a horizontal position;

a deflection arm operatively associated with said tube support surfaces and configured to move from a position away from said tube support surfaces to a position between said tube support surfaces when the textile yarn tube is placed on said tube support surfaces to inwardly deflect and collapse said textile yarn tube into a U-shaped orientation;

a controller adapted to control said deflection arm;

a placement sensor associated with said controller and adapted to provide signals to said controller when a textile yarn tube is placed within said binding apparatus, said controller adapted to count said textile yarn tubes; and a level sensor associated with said controller adapted to determine a level of textile yarn tubes present within said binding apparatus, said controller adapted to deflect said tubes when said level is determined;

wherein a plurality of the textile yarn tubes may be vertically stacked on each other between said tube support surfaces and said deflection arm and collapsed into a layered bundle of the textile yarn tubes in a U-shape when said deflection arm moves between said tube support surfaces.

24. A textile yarn tube stripper for removing yarn from a flexible tube having an opening and an inside surface comprising:

a tube receiver adapted to receive a textile yarn tube having yarn remnants wrapped about the textile yarn tube, said tube receiver having a first tube support surface spaced apart from and parallel to a second tube support surface, said tube support surfaces adapted to extend into an inside opening of the textile yarn tube and support an inside surface of the textile yarn tube;

a deflection arm operatively associated with said tube receiver and adapted to move from a position away from said tube support surfaces to a position between said tube support surfaces, said deflection arm being operable to movably engage an outside surface of and inwardly deflect the textile yarn tube when the textile yarn tube is positioned on said tube receiver;

a plurality of vacuum cups operatively associated with said tube receiver and located between and below said tube support surfaces, said vacuum cups adapted to create a vacuum to securely engage a deflected portion of the inside surface of the textile yarn tube when said deflection arm inwardly deflects the textile yarn tube, said vacuum used to hold the textile yarn tube in a deflected position; and one or more air jets operatively associated with said textile yarn tube stripper and adapted to provide a stream of air across the outside surface of the textile yarn tube to facilitate yarn remnant removal;

said tube receiver is pivotally mounted and adapted to pivot to a substantially vertical orientation when the textile yarn tube is inwardly deflected to facilitate removal of the yarn remnants from the textile yarn tube;

wherein when a textile yarn tube having yarn thereon is inserted on said tube receiver, inwardly deflected by said deflection arm, and placed in a vertical position, the yarn remnants on the textile yarn tube become loose and may be blown off of the textile yarn tube by said air jets.

25. The apparatus of claim 24 further comprising tube sensor operatively associated with said tube receiver and adapted to sense placement of the textile yarn tube on said tube receiver.

26. The apparatus of claim 24 wherein said tube sensor is further adapted to sense removal of the textile yarn tube from said tube receiver.

27. The apparatus of claim 24 wherein said tube sensor is a photosensor.

28. The apparatus of claim 24 further comprising a controller adapted to control operation of said deflection arm and said tube receiver.

29. A textile yarn tube stripper for removing yarn from a flexible tube having an opening and an inside surface comprising:

a tube receiver adapted to receive a textile yarn tube having yarn remnants wrapped about the textile yarn tube, said tube receiver having a first tube support surface spaced apart from and parallel to a second tube support surface, said tube support surfaces adapted to extend into an inside opening of the textile yarn tube and support an inside surface of the textile yarn tube;

a deflection arm operatively associated with said tube receiver and adapted to move from a position away from said tube support surfaces to a position between said tube support surfaces, said deflection arm being operable to movably engage an outside surface of and inwardly deflect the textile yarn tube when the textile yarn tube is positioned on said tube receiver;

a plurality of vacuum cups operatively associated with said tube receiver and located between and below said tube support surfaces, said vacuum cups adapted to create a vacuum to securely engage a deflected portion of the inside surface of the textile yarn tube when said deflection arm inwardly deflects the textile yarn tube, said vacuum used to hold the textile yarn tube in a deflected position;

one or more air jets operatively associated with said textile yarn tube stripper and adapted to provide a stream of air across the outside surface of the textile yarn tube to facilitate yarn remnant removal;

said tube receiver is pivotally mounted and adapted to pivot to a substantially vertical orientation when the textile yarn tube is inwardly deflected to facilitate removal of the yarn remnants from the textile yarn tube; and a tube sensor operatively associated with said tube receiver and adapted to sense placement of the textile yarn tube on said tube receiver, said adapted to sense removal of the textile yarn tube from said tube receiver;

wherein when a textile yarn tube having yarn thereon is inserted on said tube receiver, inwardly deflected by said deflection arm, and placed in a vertical position, the yarn remnants on the textile yarn tube become loose and may be blown off of the textile yarn tube by said air jets.

30. A method of yarn removal from a textile yarn tube comprising:

a) supporting the tube on two horizontally spaced apart tube support surfaces;

b) inwardly deflecting the textile yarn tube to loosen the yarn remnants on the textile yarn tube;

c) retaining the textile yarn tube in an inwardly deflected state from within the textile yarn tube; and d) removing the yarn from the textile yarn tube.

31. The method of claim 30 further comprising jetting air across the textile yarn tube to facilitate yarn removal during the removing step.

32. The method of claim 30 further comprising pivoting the textile yarn tube to a vertical orientation while in the inwardly deflected state to cause gravity to assist yarn removal during the removing step.

33. A method of yarn removal from a textile yarn tube as claimed in claim 30 further comprising binding a plurality of flexible textile yarn tubes including:

a) providing two parallel textile yarn tube support surfaces between two spaced apart vertically extending walls and spaced apart a distance that permits a textile yarn tube to rest thereon in a horizontal position and a deflection arm operatively associated with the tube support surfaces and configured to move downwardly between the tube support surfaces;

b) vertically stacking a plurality of textile yarn tubes on the tube support surfaces;

c) moving the deflection arm from a position away from said tube support surfaces to a position between the tube support surfaces to inwardly deflect and collapse the plurality of textile yarn tubes into a layer U-shaped bundle and d) binding the bundle of collapsed textile yarn tubes.

34. The method of claim 33 wherein said binding step includes sliding an additional textile yarn tube around said bundle of textile yarn tubes to surround and therefore bind the bundle.

35. A system for aiding removal of yarn from a flexible tube having an opening and an inside surface and binding a plurality of the flexible tubes after having yarn stripped therefrom, the system comprising:

a) a yarn removal section comprising:

1) a tube receiver adapted to receive a textile yarn tube having yarn wrapped about the textile yarn tube, said tube receiver having a first tube support surface spaced apart from and parallel to a second tube support surface, said tube support surfaces adapted to receive the textile yarn tube through the opening of the textile yarn tube and support the inside surface of said textile yarn tube; and 2) a deflection arm operatively associated with said tube receiver and adapted to move from a position away from said tube support surfaces to a position between said tube support surfaces, said deflection arm being operable to engage an outside surface of and inwardly deflect the textile yarn tube when the textile yarn tube is positioned on said tube receiver;

wherein when a textile yarn tube having yarn thereon is inserted on said tube receiver and inwardly deflected by said deflection arm, the yarn on the textile yarn tube becomes loosened from the tube by an effective reduction in the diameter of the tube for easy removal; and b) a tube packaging section comprising:

1) two spaced apart vertically extending side wails;

2) two parallel binding support surfaces between said side walls and spaced apart a distance that permits the textile yarn tube to rest thereon in a horizontal position; and 3) a deflection arm operatively associated with said binding support surfaces and configured to move from a position away from said binding support surfaces to a position between said binding support surfaces when the textile yarn tube is placed on said binding support surfaces to inwardly deflect and collapse said textile yarn tube into a U-shaped orientation;

wherein a plurality of the textile yarn tubes may be vertically stacked on each other between said binding support surfaces after being stripped of yarn and said deflection arm and collapsed into a layered bundle of the textile yarn tubes in a U-shape when said deflection arm moves between said binding support surfaces.

* * * * *